US005941173A

United States Patent [19]

Schier

[11] Patent Number: 5,941,173

[45] Date of Patent: Aug. 24, 1999

[54] RACE TRACK

[76] Inventor: Carl F. Schier, 6080 Old Orchard Dr., Bloomfield Hills, Mich. 48301-1469

[21] Appl. No.: 09/018,759

[22] Filed: Feb. 5, 1998

[51] Int. Cl.[6] ..... A63K 1/00

[52] U.S. Cl. ..... 104/60; 472/85

[58] Field of Search ..... 104/53, 55, 60, 104/63; 238/10 R, 10 A; 403/58, 60; 472/85, 88; 404/1

[56] References Cited

U.S. PATENT DOCUMENTS

| | | | |
|---|---|---|---|
| 809,588 | 1/1906 | Thomas et al. . | |
| 1,102,821 | 7/1914 | Thompson . | |
| 1,571,434 | 2/1926 | Ray . | |
| 1,999,052 | 4/1935 | Kennedy | 273/86 |
| 3,402,503 | 9/1968 | Glass et al. | 46/17 |
| 3,630,524 | 12/1971 | Cooper | 273/86 R |
| 4,049,274 | 9/1977 | Jevons | 463/58 |
| 4,121,821 | 10/1978 | Graham | 272/3 |
| 4,273,332 | 6/1981 | Buck et al. | 463/60 |
| 5,205,554 | 4/1993 | Copson | 104/60 |
| 5,361,705 | 11/1994 | Powell | 104/60 |
| 5,501,455 | 3/1996 | Hirata et al. | 273/86 B |
| 5,551,347 | 9/1996 | Gutknecht | 104/60 |
| 5,645,368 | 7/1997 | Yunick | 404/6 |

OTHER PUBLICATIONS

Edsall, Larry. "More Sighs Than Cheers," Autoweek, Sep. 30, 1996, p. 52.

"More big–time tracks crop up," Autoweek, Jan. 20, 1997, p. 42.

*Primary Examiner*—Mark T. Le

*Attorney, Agent, or Firm*—Gifford, Krass, Groh, Sprinkle, Anderson & Citkowski, P.C.

[57] ABSTRACT

A unique race track construction for human-driven cars having a first and second linear track which are parallel to each other and in which each linear track has a beginning and an end. A first curvilinear track has a both first end and a second end with the first end being connected to the first linear track at a position between its beginning and end. The first curvilinear track forms a complete loop section adjacent to the first linear track, thereafter extending over the first linear track adjacent to the end of the first linear track and then forms a curved track section which joins with the beginning of one of the first or second linear tracks. Similarly, a second curved linear track has one end connecting to and extending outwardly from the second linear track adjacent its end. The second curvilinear track forms a complete loop section adjacent the second linear track, thereafter crossing the second linear track at a position near the end of the second linear track and finally forms a curved track section adjacent the first linear track which joins with the beginning of the other of the first or second linear track.

8 Claims, 1 Drawing Sheet

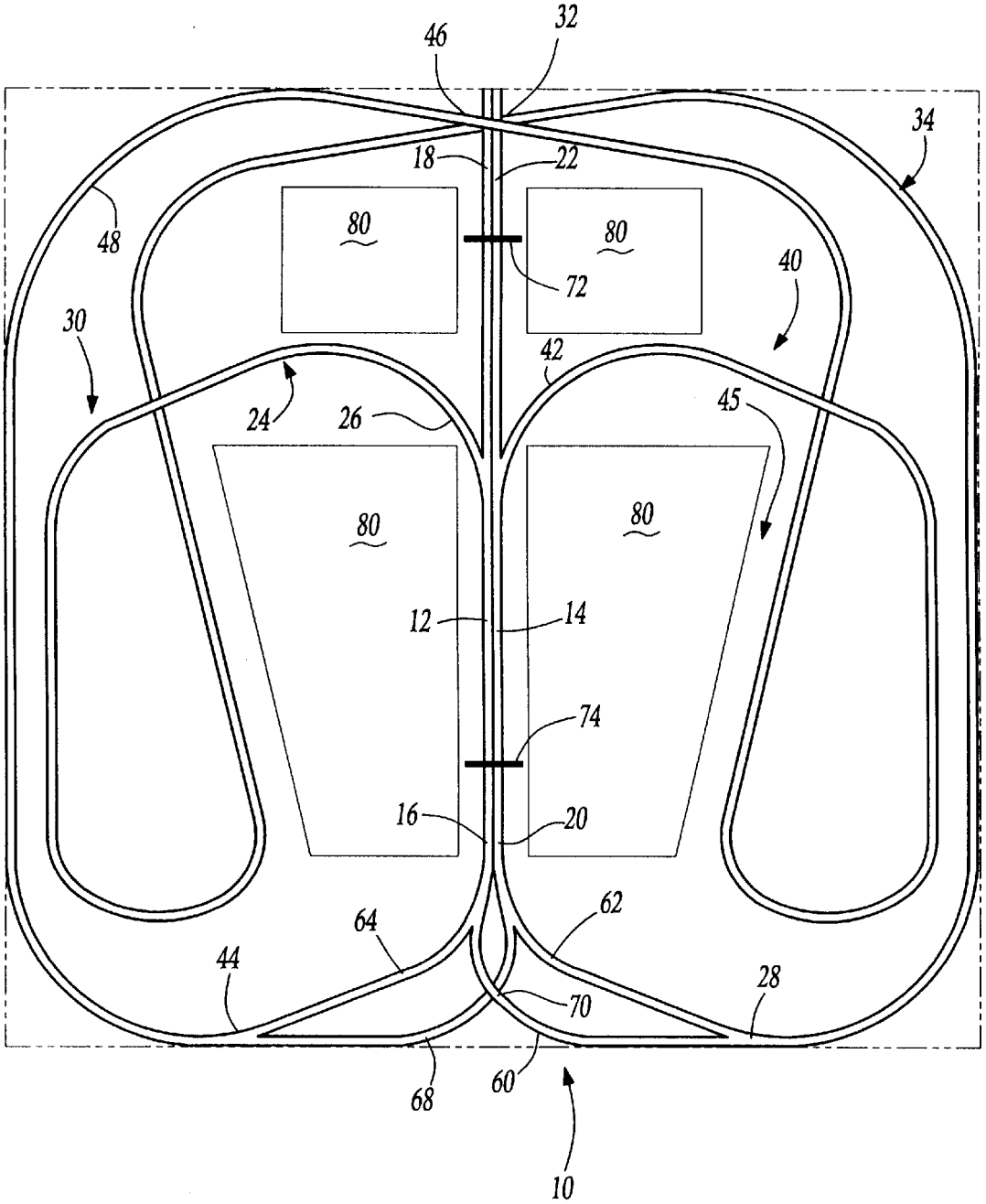
46
32
34
18
22
48
80
80
72
40
30
42
24
26
45
80
80
12
14
74
16
20
62
64
44
28
70
68
60
10

RACE TRACK

BACKGROUND OF THE INVENTION

I. Field of the Invention

The present invention relates to a race track of the type for human-driven race vehicles.

II. Description of the Prior Art

There are generally two different spectator types of tracks used in the field of human-driven racing vehicles, point to point and closed loop tracks. Drag racing utilizes a point to point track in which two linear tracks are provided in a side-by-side relationship. Each linear track has a beginning and an end and one race car, motorcycle or other vehicle is driven along each linear track. Such linear tracks typically extend in excess of a quarter mile long.

During a drag race, the race vehicles are positioned at the beginning of the straight or linear tracks and, when signaled, accelerate toward the ending of the race track. The first to cross the finish line wins the race.

Unlike drag racing, in a closed loop track, the race track is formed in a continuous loop which can be oval in shape. Two or more race vehicles race around the closed loop track for a preset number of laps, distance or time. The first race vehicle to cross the finish line after the preset number of laps is declared the winner. Stock car racing, grand prix racing and other types of racing utilize closed loop race tracks.

Both of these previously known types of race tracks, however, have disadvantages. Most importantly, however, it has been previously necessary to construct two completely separate race tracks where both point to point racing and closed loop racing are desired. This, of course, is disadvantageously expensive and requires a great deal of land.

A still further disadvantage of these previously known race tracks, is that it is difficult to maintain viewer interest during the race, and particularly to maintain viewer interest on television. For example, in point to point or drag racing, the race itself is very short and most of the time during the drag race is spent in setting up the vehicles at the start line. Similarly, in closed loop racing, the vehicles, as the race progresses become arranged so that spectators cannot discern the place, positioning or number of laps completed.

SUMMARY OF THE PRESENT INVENTION

The present invention provides a race track construction which overcomes all of the above-mentioned disadvantages of the previously known race track constructions.

In brief, the race track of the present invention comprises a first and second linear track which are generally side by side and parallel to each other. Each linear section has a beginning and an end and typically extends in excess of a quarter mile. The linear tracks are designed to accommodate conventional point to point or drag racing.

Unlike the previous point to point tracks, however, the present invention further includes a first curvilinear track having a first end and a second end. The first end is connected to the first linear track at a position between its beginning and end such that the curvilinear track extends outwardly from the first linear track.

The first curvilinear track then forms a complete loop section adjacent the first linear track, crosses over the first linear track and then forms a curved track section which terminates at the beginning of one of the two linear tracks.

Similarly, a second curvilinear track has both a first end and a second end with its first end being connected to and extending outwardly from the second linear track at a position between its beginning and end. The second curvilinear track, like the first curvilinear track, forms a complete loop section adjacent to the second linear track, thereafter crossing over the second linear track adjacent its end and forms a curved track section which terminates at the beginning of the other of the two linear tracks.

In the preferred embodiment of the invention, appropriate bridges connect the loop with the curved track for each curvilinear track in order to preclude collisions between the vehicles. Furthermore, since the vehicles travel on their own individual track during a point to point race, excitement is not only maintained for all spectators surrounding the track since a race vehicle will typically be in sight at all times, it also reduces or altogether eliminates the possibility of accidents between vehicles.

BRIEF DESCRIPTION OF THE DRAWING

A better understanding of the present invention will be had upon reference to the following detailed description when read in conjunction with the accompanying drawing, which is an elevational view illustrating a preferred embodiment of the present invention.

DETAILED DESCRIPTION OF PREFERRED EMBODIMENTS OF THE PRESENT INVENTION

With reference to the drawing, a preferred embodiment of the race track 10 in the present invention is there shown and comprises two linear tracks 12 and 14 which are side by side and parallel to each other. The first linear track 12 includes a beginning 16 as well as an end 18 while, similarly, the second linear track 14 includes a beginning 20 and an end 22. Preferably, the distance between the beginning and end of each of the linear tracks 12 and 14 is in excess of one quarter mile.

The race track further comprises a first curvilinear track 24 having both a first end 26 and a second end 28. The first end 26 is connected to and extends outwardly from the first linear track 12 at a midpoint between its beginning 16 and end 18. From its first end 26, the curvilinear track 24 first forms a complete loop section 30 adjacent the first linear track 12 which ends in an under bridge 32 which extends under the linear tracks 12 and 14 adjacent their ends 18 and 22. After the under bridge 32, the curvilinear track 24 includes a curved track section 34 which extends adjacent the second linear track 14 and terminates at its end 28. The end 28 of the first curvilinear track 24 is connected to both the beginnings 16 and 20 of the linear tracks 12 and 14 by track sections 60 and 62, respectively. In use, one of the track sections 60 or 62 is gated off or otherwise closed.

Similarly, the race track 10 further comprises a second curvilinear track 40 having a first end 42 and a second end 44. The first end 42 is connected to and extends outwardly from the second linear track 14 at a point intermediate its end 20 and 22. The curvilinear track 40 first includes a complete loop section 44 adjacent the second linear track 14. This loop section 44 terminates in a bridge 46 which extends over the linear tracks 12 and 14 adjacent their ends 18 and 22. The curvilinear track 40 then continues in a curved track section 48 extending around the first loop 30 and terminates at its end 44. The end 44 of the second curvilinear track 40 is connected to both the beginnings 16 and 20 of the linear tracks 12 and 14 by track sections 64 and 68, respectively. In use, one of the track sections 64 and 68 is gated off or otherwise closed. Furthermore, a bridge 70 on the track section 60 extends over the track section 68.

The race track 10 present invention is designed for use with human-driven vehicles. In the event that point to point or drag racing is desired, the vehicles (not shown) are first positioned at a start line 74 adjacent the beginning 16 and 20 of the linear tracks 12 and 14, respectively, in the well known fashion. During a drag race, the vehicles 50 are driven down the linear tracks 12 towards the ends 18 or 22. The first vehicle to reach a finish line 72 is declared the winner.

The race track 10 of the present invention can also be used for closed loop racing. For example, assume that a vehicle is first positioned at the start line 74 of the first linear track 12. After the race begins, the vehicle first travels around the first curvilinear track 24 and thus around the loop section 30 and curved track section 34. After reaching the end 28 of the first curvilinear track 24 and assuming that the track section 60 is blocked off, the vehicle then continues to travel along the track section 62, down the second linear track 14 and around the second curvilinear track 40. The vehicle thus travels around the loop 44 and curved track section 48 until the vehicle again crosses the beginning 16 of the first linear track 12, assuming the track section 68 is blocked. Consequently, in doing so, the car travels around the complete race track 10 with the exception of the ends of the linear tracks 12 and 14. A typical race may consist of a single lap around the race track 10, or a predetermined number of laps around the race track 10.

Alternatively, the track sections 64 and 62 are blocked off. In this case, one vehicle travels only around the linear track 12 and curvilinear track 24 while the other vehicle travels only around the linear track 14 and curvilinear track 40.

The track also preferably includes viewing stands 80.

From the foregoing, it can be seen that the race track of the present invention can be used both for point to point racing as well as closed loop racing.

Having described my invention, however, many modifications thereto will become apparent to those skilled in the art to which it pertains without deviation from the spirit of the invention as defined by the scope of the appended claims.

I claim:

1. A race track construction for human driven cars comprising:

a first and second linear track, each linear track having a beginning and an end, said linear tracks being side by side and parallel to each other, a first curvilinear track having a first end and a second end, said first end being connected to said first linear track at a position intermediate said beginning and said end of said first linear track, said first curvilinear track forming a complete loop section adjacent said first linear track, thereafter extending under said linear tracks adjacent said ends of said linear tracks and thereafter forming a curved track section such that said second end of said first curvilinear track joins with said beginning of one of said first or second linear track, a second curvilinear track having a first end and a second end, said first end being connected to said second linear track at a position intermediate said beginning and said end of said second linear track, said second curvilinear track forming a complete loop section adjacent said second linear track, thereafter extending over said linear tracks adjacent said ends of said linear tracks and thereafter forming a curved track section such that said second end of said second curvilinear track joins with said beginning of the other of said first or second linear track.

2. The invention as defined in claim 1 wherein said curved track section of said first curvilinear track extends adjacent said second linear track.

3. The invention as defined in claim 1 wherein said curved track of said second curvilinear track extends adjacent said first linear track.

4. The invention as defined in claim 1 and comprising a bridge joining each loop section with its respective curved track section.

5. The invention as defined in claim 1 wherein said one linear track is said first linear track.

6. The invention as defined in claim 1 wherein said one linear track is said second linear track section.

7. The invention as defined in claim 1 wherein each said linear track is at least one quarter mile long.

8. The invention as defined in claim 4 wherein each said bridge extends over a portion of its respective loop section.

* * * * *